US008683773B2

(12) United States Patent
Emmons et al.

(10) Patent No.: US 8,683,773 B2
(45) Date of Patent: Apr. 1, 2014

(54) SYSTEM AND METHOD FOR LEAKING CRACK REPAIR

(75) Inventors: Peter H. Emmons, Finksburg, MD (US); Brent D. Anderson, Edina, MN (US)

(73) Assignee: Structural Group, Inc., Hanover, MD (US)

( * ) Notice: Subject to any disclaimer, the term of this patent is extended or adjusted under 35 U.S.C. 154(b) by 198 days.

(21) Appl. No.: 13/107,595

(22) Filed: May 13, 2011

(65) Prior Publication Data

US 2011/0277413 A1 Nov. 17, 2011

Related U.S. Application Data

(60) Provisional application No. 61/395,391, filed on May 13, 2010.

(51) Int. Cl.
*E02D 37/00* (2006.01)

(52) U.S. Cl.
USPC ..... 52/741.41; 52/2.13; 52/514.5; 52/741.4; 52/742.16

(58) Field of Classification Search
USPC ..... 52/2.13, 514, 514.5, 741.4, 741.41, 52/742.1, 742.16; 404/72, 73.1, 75, 87, 404/89, 90, 93, 94, 107; 29/451, 458, 29/527.1, 527.2; 277/583, 644, 645, 649, 277/464; 156/94, 98, 71
See application file for complete search history.

(56) References Cited

U.S. PATENT DOCUMENTS 2,071,299 A 2/1937 Gammeter
(Continued)

FOREIGN PATENT DOCUMENTS

JP 62-236884 10/1987
KR 100903417 6/2009

OTHER PUBLICATIONS

"Chapter 16—Tunnel Rehabilitation." Structures. U.S. Department of Transportation Federal Highway Administration. http://www.fhwa.dot.gov/bridge/tunnel/pubs/nhi09010/16.cfm. Accessed May 2, 2011.

(Continued)

*Primary Examiner* — Robert Canfield
*Assistant Examiner* — Matthew Gitlin
(74) *Attorney, Agent, or Firm* — Whiteford, Taylor & Preston, LLP; Gregory M. Stone

(57) ABSTRACT

Disclosed is a system and method for providing a concrete crack repair system that is capable of providing a pressurized seal that continues to resist the ingress of water even as the crack continues to open and close over time. A compressible seal is provided that may be inserted into and adhesively joined to a machined groove that follows the contour of the crack in the concrete surface. After its installation in the machined groove, grout may be injected into the machined groove below the compressible seal so as to fill the space between the compressible seal and the bottom of the machined groove, which grout may also flow into the groove that is adjacent the bottom of the machined groove, thus allowing pressurized grouting of the crack itself. The compressible seal may also include an interior, hollow chamber that may allow inflation of the compressible seal within the machined groove, thus forming a permanent pressurized seal above the crack.

25 Claims, 8 Drawing Sheets

(56) References Cited

U.S. PATENT DOCUMENTS

| | | | | | |
|---|---|---|---|---|---|
| 2,156,681 | A | * | 5/1939 | Dewhirst et al. | 404/65 |
| 2,333,826 | A | | 11/1943 | Folsom et al. | |
| 3,286,425 | A | * | 11/1966 | Brown | 52/396.06 |
| 3,334,557 | A | | 8/1967 | Fitzgibbon | |
| 3,461,781 | A | | 8/1969 | Weiner et al. | |
| 3,524,390 | A | * | 8/1970 | Dill | 404/49 |
| 3,813,180 | A | | 5/1974 | O'Brill | |
| 4,285,612 | A | * | 8/1981 | Betti | 404/68 |
| 4,305,680 | A | | 12/1981 | Rauchfuss, Jr. | |
| 4,622,784 | A | | 11/1986 | Black et al. | |
| 4,655,638 | A | | 4/1987 | Waring | |
| 4,740,404 | A | | 4/1988 | Otsugu et al. | |
| 4,793,162 | A | | 12/1988 | Emmons | |
| 4,817,963 | A | * | 4/1989 | Munden et al. | 277/316 |
| 4,884,381 | A | | 12/1989 | Betti | |
| 4,905,430 | A | * | 3/1990 | Schmidt | 52/514.5 |
| 5,027,568 | A | * | 7/1991 | Schmidt | 52/514.5 |
| 5,063,006 | A | | 11/1991 | Tahara | |
| 5,079,881 | A | * | 1/1992 | Haage et al. | 52/514.5 |
| 5,155,965 | A | * | 10/1992 | Tabei et al. | 52/742.16 |
| 5,476,340 | A | * | 12/1995 | Contrasto | 404/75 |
| 5,489,164 | A | | 2/1996 | Tusch et al. | |
| 5,531,455 | A | * | 7/1996 | Calixto | 277/646 |
| 5,619,831 | A | * | 4/1997 | Reay | 52/396.04 |
| 5,881,523 | A | * | 3/1999 | Quatrochi, Jr. | 52/514.5 |
| 6,309,493 | B1 | | 10/2001 | Braun et al. | |
| 6,427,405 | B1 | * | 8/2002 | Moriya et al. | 52/396.04 |
| 7,273,048 | B1 | * | 9/2007 | Zuzelo | 125/13.01 |
| 7,806,624 | B2 | | 10/2010 | McLean et al. | |
| 2004/0187235 | A1 | | 9/2004 | Elias et al. | |
| 2008/0190055 | A1 | | 8/2008 | Schmid | |
| 2009/0084057 | A1 | * | 4/2009 | Hwang | 52/514 |
| 2012/0304577 | A1 | * | 12/2012 | Reid et al. | 52/514.5 |

OTHER PUBLICATIONS

"Control of Cracking in Concrete: State of the Art." Transportation Research Circular No. E-C107 Oct. 2006. Transportation Research Board of the National Academies.

Jeene Multi-Directional Structural Sealing Joint System. Watson Bowman Acme product description. 4 pages. http://products.construction.com/swts_content_files/15434/520281.pdf Accessed Sep. 19, 2012.

Wabo Pavement Seal—Pre-formed elastomeric joint seal. Watson Bowman Acme product description. 4 pages. http://www.wbacorp.com/public/userfiles/WaboPavementSeal_1206_DataSheet.pdf Accessed Sep. 19, 2012.

CS Expansion Joint Systems for Parking Structures. CS Construction Specialties brochure. 7 pages.

* cited by examiner

SYSTEM AND METHOD FOR LEAKING CRACK REPAIR

CROSS REFERENCE TO RELATED APPLICATION

This application is based upon and claims priority from U.S. Provisional Patent Application Ser. No. 61/395,391 entitled "Novel Means of Sealing Cracks in Concrete to Stop the Penetration of Water," filed with the U.S. Patent and Trademark Office on May 13, 2010 by the inventors herein, the specification of which is incorporated herein by reference.

FIELD OF THE INVENTION

This invention relates generally to the repair of cracks in concrete structures, and more particularly to systems and methods for permanently waterproofing leaking cracks in concrete that are subject to opening and closing over time.

BACKGROUND

Concrete structures, such as tunnels, pavements, bridges, foundations, and the like, are often prone to the development of cracks. Concrete contracts and expands with changes in moisture and temperature, and can deflect based on the load applied to the structure and the support conditions for the structure. While cracks can more easily develop in concrete structures as a result of improper design and construction practices, all concrete structures will, regardless of construction techniques, have some tendency to develop cracks. That tendency may increase as a result of particular mechanical loads on the concrete structure, settlement, shrinkage in both fresh and hardened concrete structures, temperature changes, corrosion, and the like.

Of course, the development of significant cracks in concrete structures can adversely affect the performance of such structures. Thus, efforts have been made to provide for the control and repair of cracks in concrete structures. For instance, attempts have been made to control crack development by optimizing the composition of the concrete structure through material selection and proportioning, optimizing construction practices for the particular structure and its use conditions, and the like. Further, attempts have been made to provide for the repair of cracks in concrete structures, such as by filling the crack with sealers, such as epoxy, methacrylate, urethane, mastics, thermoplastics, elastomers, vinyl ester resin, amine resin, polyester resin, and the like, all with and/or without prior machining and shaping of the crack, along with structural reinforcement of the structure surrounding the area of the crack (e.g., placing a grid of reinforcing steel over the cracked area).

For example, one prior technique for attempting to control water leakage through cracked concrete elements has comprised dry packing oakum that was impregnated with a binder (e.g., pine-tar, asphalt and coal tar residues, water reactive mastics, caulks, sealants and liquid urethanes) into the crack, at times with other hydrophilic components. Upon contact with water, the impregnated oakum would expand to close the crack. Likewise, Cured-In-Place polymeric seals have been used (e.g., rigid epoxy mastics and flexible sealants) in routed-out cracks for surface seals, with back-rods and/or bond-breaking tapes and composites placed in the base of the routed slots. Similarly, cementitious grout plugs have been used to plug routed-out slots, and flexible and rigid sheet composites have been placed over the leaking crack or joint and affixed to the concrete surface. Each of these prior attempts, however, have had their respective shortcomings and have not been entirely suitable for the long term waterproof sealing of cracks that are prone to opening and closing over time.

A particular challenge exists with regard to the repair of concrete structures exposed to hydrostatic water pressure, such as many tunnels. Water intrusion into cracks in concrete can accelerate corrosion of reinforcing steel and lead to deterioration of the concrete itself. Control and repair of such cracks, while critical to maintaining the integrity of the structure, can be difficult. Typically, in attempting to seal a leaking crack in a concrete structure, a chemical or cementitious grout is injected into the crack.

However, injecting cracks with such fill materials often prove insufficient, as the seal provided by such material tends to fail as the crack opens and closes over time. For example, U.S. Pat. No. 6,309,493 issued Oct. 30, 2001 describes a method for filling cracks in a concrete structure with foamable polyurethane prepolymer, and provides an injection port that can be utilized for delivering a foaming solution to a crack in the concrete structure. While potentially suitable for temporarily sealing small cracks in concrete, such application would not be suitable for the permanent, water-tight sealing of significant cracks in concrete structures, as the continuous expansion and contraction of the concrete would quickly break the seal formed by such material.

Similarly, Japanese Patent Publication No. 62-236884 published Oct. 16, 1987 describes a method for repairing a crack in concrete, which process includes creating a chamber at a leakage point, inserting an impregnating pipe into the chamber, and applying a rapid bonding agent around the impregnating pipe to seal the chamber. Grout is then applied to the chamber through the impregnating pipe. The grout, in the form of polyurethane, reacts with moisture in the chamber and expands, thus sealing (at least temporarily) the crack in the concrete. Once again, while potentially suitable for temporarily sealing small cracks in concrete, such application would not be suitable for the permanent, water-tight sealing of significant cracks in concrete structures, as the continuous expansion and contraction of the concrete would quickly break the seal formed by such material.

It is important that repairs of concrete cracks provide a permanent, water-tight seal that resists the ingress of water even as the crack continues to open and close. Joint systems have previously been provided for sealing finished joints in various structures, such as bridges, tunnels, parking decks, stadiums, buildings, reservoirs, and waste water treatment facilities by using expansion joints. One such example of an expansion joint is shown in U.S. Pat. No. 4,884,381 issued Dec. 5, 1989, which provides a joinder system for providing a seal between a pair of opposed walls. The system has a sealing element with a longitudinal cavity and a plurality of ribs, and is placed between two structural elements, such as a pair of opposed walls of a roadbed or building. Adhesive material is applied between the sealing element and the opposed walls. After the sealing element is placed at a desired location between the two walls, a filler material is injected into the longitudinal cavity under pressure causing the sealing element to expand and the ribs to press the adhesive material into the walls. While such systems may be useful in providing a sealing joint between planar wall surfaces and similarly configured, finished joint faces, they are typically not suitable for use in sealing irregularly shaped cracks that may randomly form in the concrete structure.

Unfortunately, as the foregoing attempted solutions tend to fail once the crack opens, causing the injected material to break down and/or separate from the edges of the crack and thus allowing water intrusion to continue, they have not proven to be permanent solutions. Thus, there remains a need in the art for an effective means of permanently sealing leaking cracks in concrete that are subject to opening and closing over time. It would thus be advantageous to provide a method and system suitable for permanently sealing irregularly shaped cracks in concrete structures in a water-tight manner that maintain a seal even through the ongoing opening and closing of the crack.

SUMMARY OF THE INVENTION

Disclosed is a system and method for providing a concrete crack repair system that is capable of providing a pressurized seal that continues to resist the ingress of water even as the crack continues to open and close over time. While suitable for a variety of concrete crack repair applications, such a solution may be particularly well suited for application to negative pressure side concrete wall waterproofing, such as would be performed on the inside surface of a tunnel wall.

In use, a flexible insert in the form of an elastomeric, compressible seal is provided that is configured for insertion within and permanent attachment to a machined groove that extends above and along the path of a crack in a concrete structure. An existing crack in a concrete structure is machined to form a constant width and constant depth groove over the location of the original crack. The compressible seal is then inserted into the machined groove, with the sidewalls of the compressible seal being adhesively joined to the sidewalls of the machined groove. Preferably, the top side of the compressible seal is configured to, once installed, lie flush with the concrete wall face, although other configurations are suitable and may be used without departing from the spirit and scope of the invention. The bottom side of the compressible seal is configured to, once installed, create a grout-receiving space between the bottom of the compressible seal and the machined groove. Once the compressible seal is installed within the machined groove, a grout may be injected into the grout-receiving space to fill that space, and may likewise extend into at least a portion of the original crack itself, in turn providing a compressed but flexible and movable seal above the crack. The injection of such grout will prevent water from tracking along the length of the seal in the event that future movement of the crack leads to water reaching the seal at some location.

The compressible seal may have a hollow, inflatable interior chamber within the body portion of the compressible seal. In this case, once the compressible seal is placed within the machined groove, the compressible seal may be inflated to place the compressible seal itself in a permanent state of compression within the machined groove. For example, air may be injected into the interior chamber so as to inflate the interior chamber and create a permanent, pressurized seal above the crack. Likewise, a vacuum may be applied to the interior chamber to draw in the flexible sidewalls of the seal, and once installed may be removed so as to cause the compressible seal to expand within the machined groove.

Still further, a polymer grout, cementitious grout, expansible foam or the like may be injected into the interior chamber to inflate the interior chamber and create a permanent pressurized seal above the crack, either alone or in combination with prior inflation with air or prior application and then release of a vacuum from the interior chamber.

In order to provide a completely sealed, watertight condition at the ends of the compressible seal, cylindrical plugs may be provided at each end of the compressible seal. The cylindrical plugs may have a hollow, interior chamber that may be inflated or subjected to a vacuum that is withdrawn after installation, as described above with respect to the compressible seal. The cylindrical plug may be adhesively affixed to a cylindrical bore machined into the concrete surface at each end of the machined groove, with each cylindrical bore extending to a depth greater than the depth of the machined groove. Once installed within such cylindrical bore, the cylindrical plugs provide a permanently sealed, waterproof end plug for the compressible seal.

With regard to certain aspects of a particularly preferred embodiment, a method of repairing a crack in a concrete structure is disclosed, comprising the steps of identifying a path of a crack within a surface of a concrete structure; forming a groove having a constant depth and width in the surface and along the path; and affixing a flexible insert on an interior of the groove, wherein after the flexible insert is affixed on the interior of the groove, it is maintained in a state of compression within the groove. That state of compression may be achieved by inflating the flexible insert to form a permanent pressurized seal above the crack, such as by injecting air into the chamber within the flexible insert, applying a vacuum to such chamber and then releasing the vacuum once the insert is installed in the groove, or injecting the chamber with a grout, foam, or other material, either alone or in combination with air injection or vacuum application and release. With regard to further aspects of such embodiment, the method further comprises the step of injecting a grout between the bottom face of the groove and the flexible insert so that the grout is forced into the crack.

With regard to other aspects of a particularly preferred embodiment, a method of repairing a crack in a concrete structure is disclosed, comprising the steps of providing a compressible seal comprising a body portion having a top side and a bottom side opposite the top side, a hollow interior chamber within the body portion, and a plurality of ribs extending along a length dimension of the body portion; identifying a path of a crack within a surface of a concrete structure; forming a machined groove having a constant depth and width in the surface along the path, and wherein the bottom side of the compressible seal is configured to, once installed, create a grout-receiving space between the bottom side of the compressible seal and the machined groove; and affixing the compressible seal on the interior of the groove, wherein after the flexible insert is affixed on the interior of the groove, it is maintained in a state of compression within the groove. That state of compression may be achieved by inflating the compressible seal to form a permanent pressurized seal above the crack, such as by injecting air into the hollow interior chamber, applying a vacuum to such chamber and then releasing the vacuum once the insert is installed in the groove, or injecting the chamber with a grout, foam, or other material, either alone or in combination with air injection or vacuum application and release. With regard to further aspects of such embodiment, the method further comprises the step of injecting a grout into the grout-receiving space so as to fill the grout-receiving space and at least a portion of the crack with the grout.

With regard to further aspects of a particularly preferred embodiment, a method of repairing a crack in a concrete structure is disclosed, comprising the steps of providing a compressible seal comprising a body portion having a top side and a bottom side opposite the top side; identifying a path of a crack within a surface of a concrete structure; forming a machined groove having a constant depth and width in the surface along the path, and wherein the bottom side of the compressible seal is configured to, once installed, create a grout-receiving space between the bottom side of the compressible seal and the machined groove; affixing the compressible seal on the interior of the groove; and injecting a grout into the grout-receiving space so as to fill the grout-receiving space and at least a portion of the crack with the grout to form a permanently pressurized seal above the crack.

With regard to still further aspects of a particularly preferred embodiment, a permanent seal in a machined groove within a concrete structure is disclosed, wherein the machined groove extends along a path of a crack within the concrete structure and has a constant width and constant depth, the permanent seal comprising a body portion having a top side and a bottom side opposite the top side, and two side walls between the top side and the bottom side; wherein the compressible seal is positioned within the machined groove so that the top side is flush with the face of the concrete structure and a grout-receiving space is defined between the bottom side and a bottom face of the machined groove; adhesive permanently affixing each of the side walls to each of the two side faces of the machined groove; and a grout filling the grout-receiving space and entering into at least a portion of the crack, wherein said grout is under compression and forms a permanent seal above the crack.

BRIEF DESCRIPTION OF THE DRAWINGS

The numerous advantages of the present invention may be better understood by those skilled in the art by reference to the accompanying figures in which.

DETAILED DESCRIPTION OF THE PREFERRED EMBODIMENTS

Figure 1:
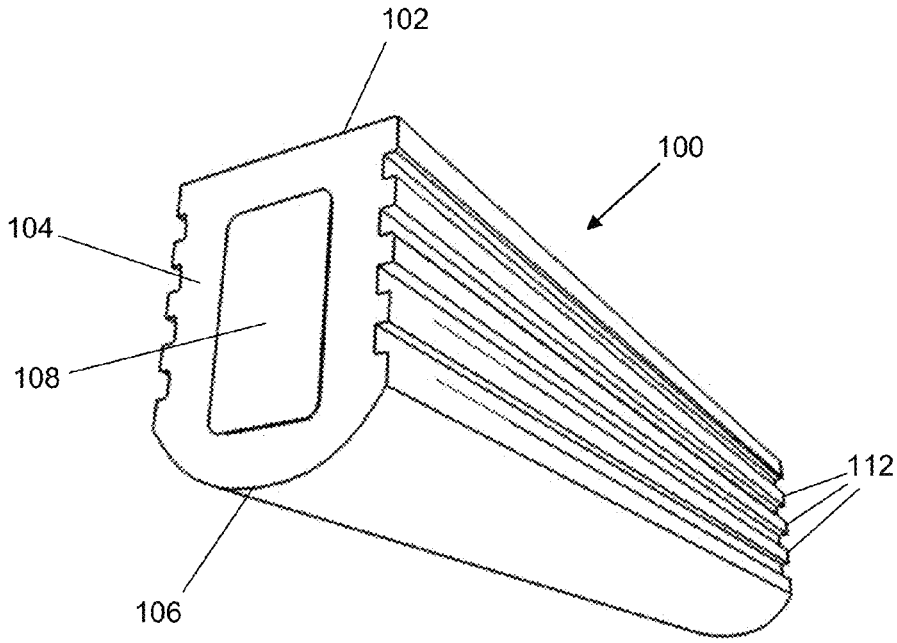
FIG. 1 is a perspective view of a compressible seal according to certain aspects of an embodiment of the invention.

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Disclosed is a system and method for providing a concrete crack repair system that is capable of providing a pressurized seal that continues to resist the ingress of water even as the crack continues to open and close over time. Such a solution may be particularly well suited for application to negative pressure side concrete waterproofing, such as would be performed on the inside surface of a tunnel wall. However, the system and method described herein are broadly applicable to concrete crack repair applications in structures designed to exclude water and to retain water, and applications in water conduits generally, and thus are suitable for both positive and negative side waterproofing of concrete cracks, and in fact any application of concrete crack repair in which the crack is subject to ongoing opening and closing over time.

A compressible seal is provided that may be inserted into a machined groove that follows the contour of the crack in the concrete surface. The compressible seal is preferably affixed to the machined groove with an adhesive. The top side of the compressible seal is configured to, once installed within the machined groove, lie flush with the concrete wall face. The bottom side of the compressible seal is configured to, once installed within the machined groove, create a grout-receiving space between the bottom of the compressible seal and the machined groove. Once the compressible seal is installed within the machined groove, a grout may be injected into the grout-receiving space to fill that space, and may likewise extend into at least a portion of the original crack itself, thus providing pressurized grouting of the crack itself and, in turn, providing a compressed but flexible and movable seal above the crack.

The compressible seal may have a hollow, inflatable interior chamber within the body portion of the compressible seal. In this case, once the compressible seal is placed within the machined groove, the compressible seal may be inflated to place the compressible seal itself in a permanent state of compression within the machined groove. For example, air may be injected into the interior chamber so as to inflate the interior chamber and create a permanent, pressurized seal above the crack. Likewise, a vacuum may be applied to the interior chamber to draw in the flexible sidewalls of the seal, and once installed may be removed so as to cause the compressible seal to expand within the machined groove. Still further, a grout material, including by way of non-limiting example a polymer resin grout, a cementitious grout, a compressible foam grout, or any other grout that will harden after being injected into the interior chamber in a flowable form may be injected into the interior chamber to inflate the interior chamber and create a permanent pressurized seal above the crack, either alone or in combination with prior inflation with air or prior application and then release of a vacuum from the interior chamber.

Once installed, the compression seal becomes a pressurized seal that remains intact, even during subsequent movement of the crack, preventing moisture intrusion even as the crack grows or the hydrostatic pressure in the crack increases. That pressurized compression seal remains in a permanently compressed state, thus preventing breach during changes in crack width and hydrostatic pressure.

As shown in the perspective view of FIG. 1, a compressible seal (shown generally at 100) is provided having a top side 102 and a groove-engaging body portion 104 extending generally downward from top side 102. Compressible seal 100 is preferably formed of an elastomeric material, and particularly may comprise a preformed elastomeric polymer, and is provided as a generally elongated strip having a length that is at least several times greater than the height of the compressible seal (measured from the bottom side 106 of body portion 104 to top side 102). Compressible seal 100 is preferably formed of a material that, when inflated (as discussed in greater detail below), may form a watertight seal within the machined groove in which it is installed, and likewise that may be cut to fit the length of the machined groove in which it is to be installed.

Compressible seal 100 is provided a hollow interior chamber 108 that preferably extends along the entire length of compressible seal 100, although it may optionally be segmented into separate interior chambers 108 along the length of compressible seal 100. As discussed in greater detail below, interior chamber 108 may be accessed using a grout injector to pierce through top side 102 of compressible seal 100, and into interior chamber 108, so as to allow a grout material as described above to be injected into and fill and inflate interior chamber 108. Suitable grout injection devices are known in the art and are readily commercially available, and thus are not further detailed here. Interior chamber 108 may be rectangular, as shown in the exemplary embodiment of FIG. 1, or may have any of a variety of geometric configurations, such as circular or ovular, without departing from the spirit and scope of the invention. When interior chamber 108 is inflated, the sides of body portion 104 of compressible seal 100 are compressed against the sidewalls of the machined groove in which compressible seal 100 is installed, thus placing the compressible seal 100 in a permanently compressed condition.

Figure 7:
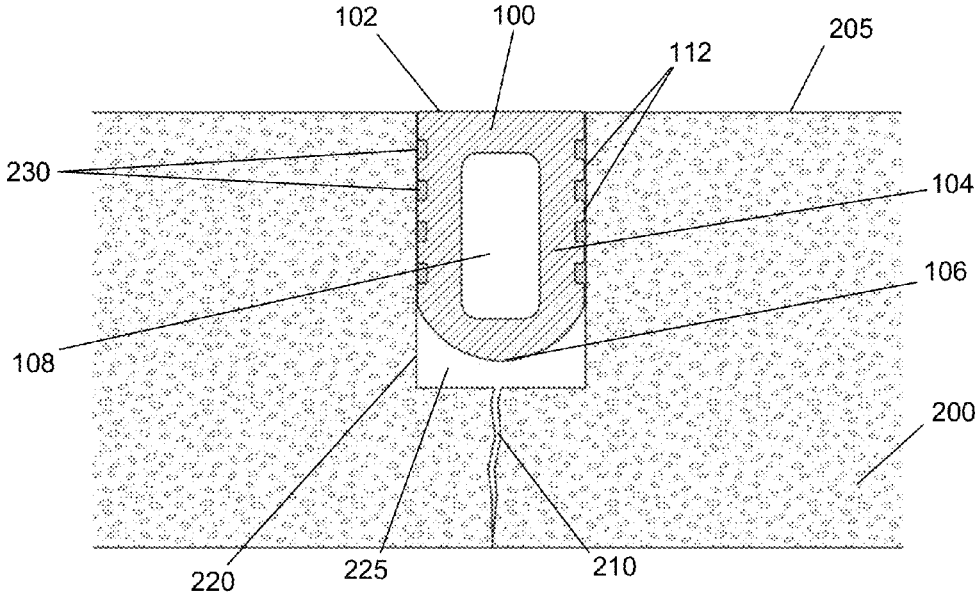
FIG. 7 is a side, cross-sectional view of a compressible seal inserted in the machined groove of FIG. 5.

Bottom side 106 of compressible seal 100 is contoured such that when compressible seal 100 is installed within a machined groove (as shown in FIG. 7 and discussed in greater detail below), a grout-receiving space is defined between bottom side 106 of compressible seal 100 and the bottom face of the machined groove. While bottom side 106 of compressible seal 100 is shown in FIG. 1 as having a convex shape, it may be concave or have any other contour so long as a grout-receiving space is defined after the compressible seal 100 is installed in the machined groove. That contour of bottom side 106 preferably extends along the entire length of compressible seal 100. The resulting grout-receiving space may be accessed again using a grout injector to pierce through the bottom of interior chamber 108 and through bottom side 106 of compressible seal 100 after compressible seal 100 has been adhesively affixed to the machined groove, all as detailed further below. A grout may be injected into the grout-receiving space, filling that space and at least a portion of the crack itself that is adjacent the bottom of the machined groove in which compressible seal 100 is installed. As the grout-receiving space is filled after interior chamber 108 has been inflated to form a compressed seal, such filling of the grout-receiving space provides for pressurized grouting of the crack itself.

Additionally, ribs 112 extend outward from both sidewalls of body portion 104 of compressible seal 100, and preferably extend along the entire length of compressible seal 100. While the ribs themselves assist in holding the compressible seal 100 within a machined groove, they also define spaces between adjacent ribs that, as discussed in greater detail below, may receive an adhesive to permanently affix compressible seal 100 within the machined groove.

Figure 2A:
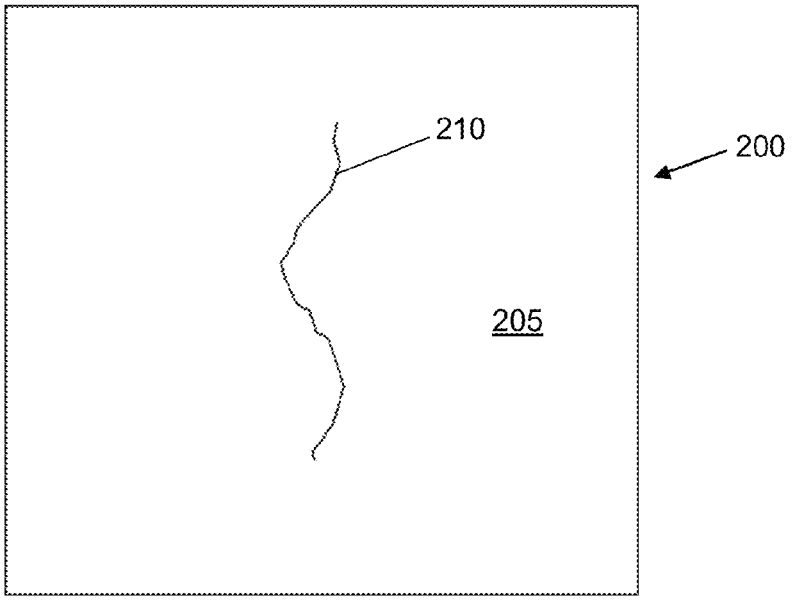
FIG. 2*a* is a top view of a crack in a concrete structure suitable for repair using a method in accordance with the invention.
Figure 2B:
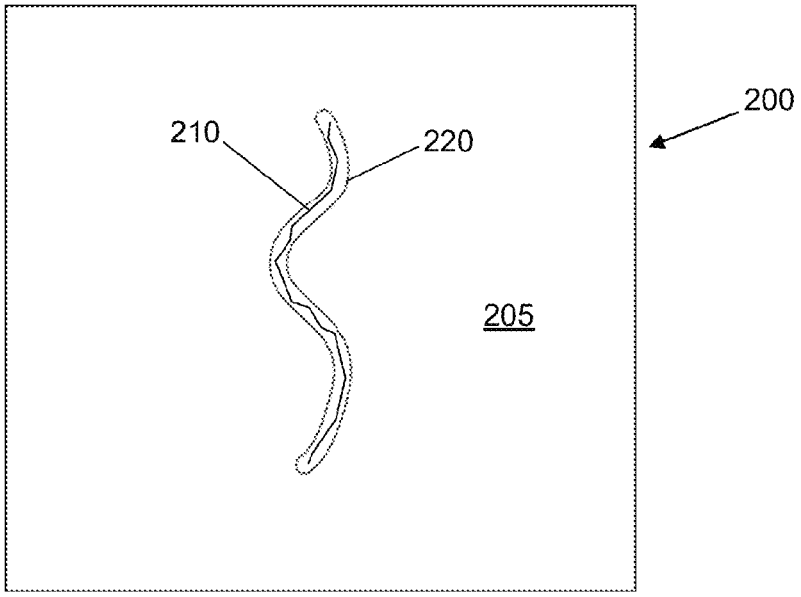
FIG. 2*b* is a top view of a machined groove in the concrete structure of FIG. 2*a*.
Figure 3:
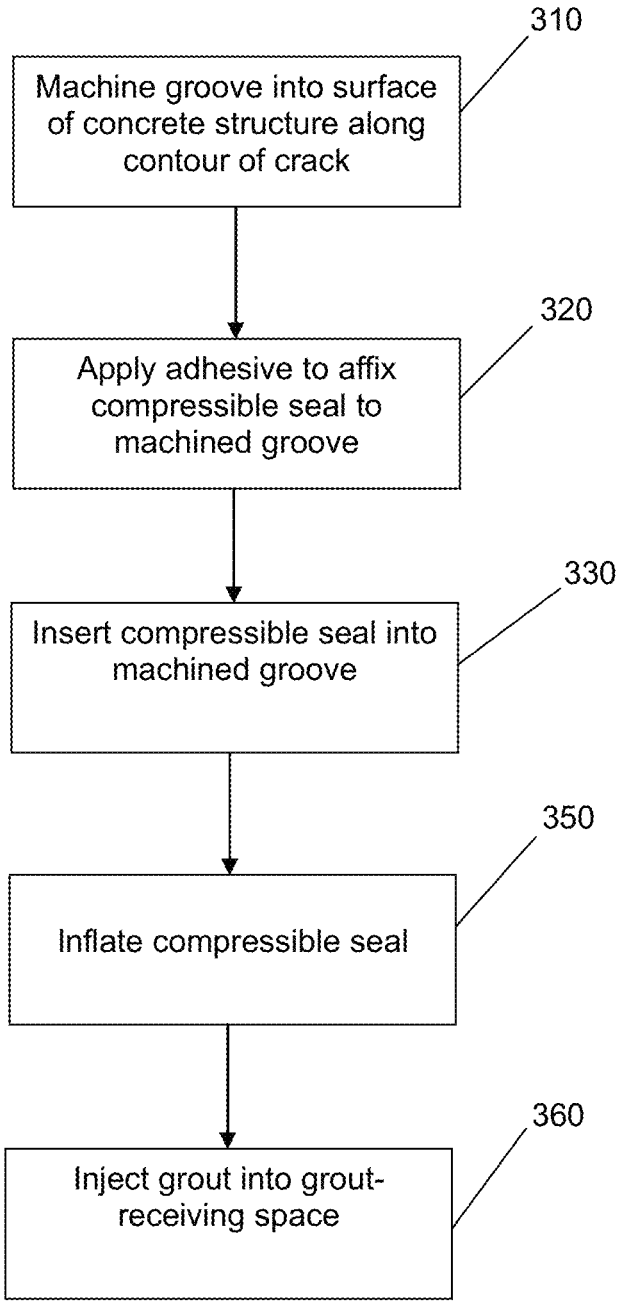
FIG. 3 is a schematic representation of an exemplary method for repairing a crack in a concrete structure in accordance with certain aspects of an embodiment of the invention.
Figure 4:
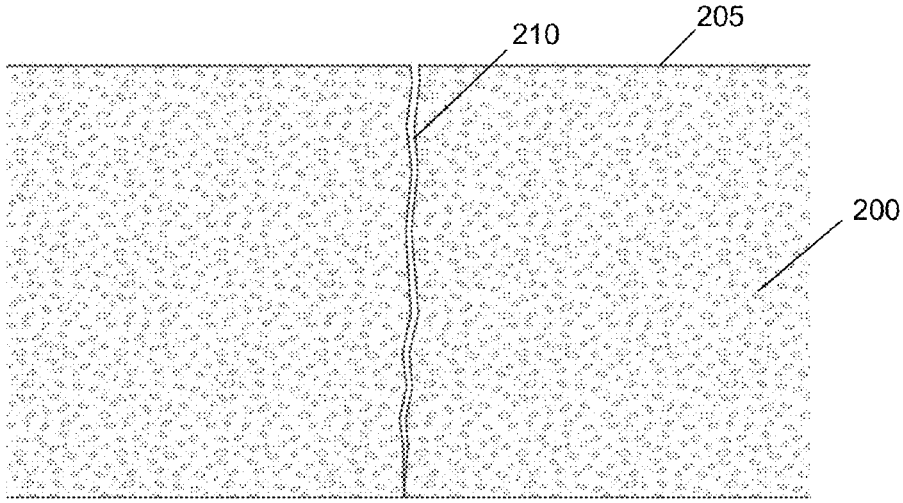
FIG. 4 is a side, cross-sectional view of a crack in a concrete structure suitable for repair using a method in accordance with the invention.
Figure 5:
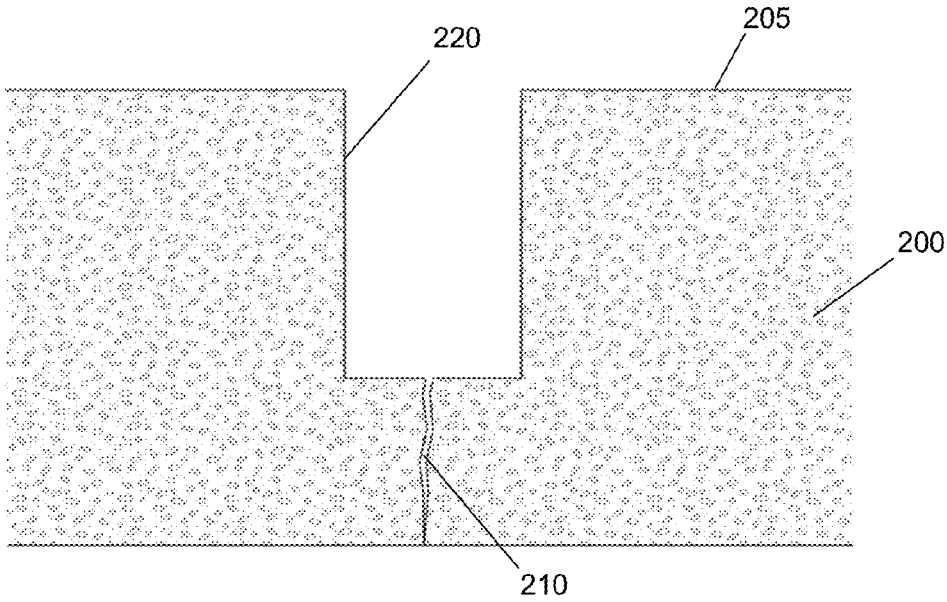
FIG. 5 is a side, cross-sectional view of a machined groove in the concrete structure of FIG. 4.
Figure 6:
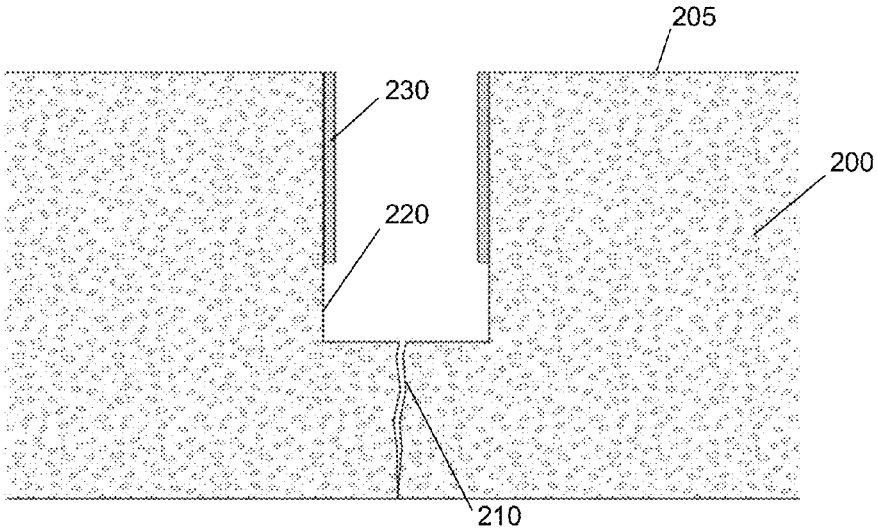
FIG. 6 is a side, cross-sectional view of the machined groove of FIG. 5 with adhesive applied to the groove.

Compressible seal 100 is preferably sufficiently flexible so that it may bend and curve along its length, and thus fit within a groove that itself bends and/or curves along with the contour of the crack that is to be repaired. By maintaining such linear flexibility while forming a permanently compressed seal, compressible seal 100 prevents breach of the crack during further changes in the crack width and hydrostatic pressure, and thus may be used in those situations where cracks are dynamically changing on a continuous basis, and even where after-leaking through the crack is ongoing. Thus, and with reference to FIGS. 2*a*-2*b*, a concrete wall section (shown generally at 200) may have a crack 210 extending along its surface 205. As discussed in greater detail below, the crack 210 may be machined into a machined groove 220 (FIG. 2*b*) having a constant width and depth throughout its length, and thereafter compressible seal 100 may be fitted into the machined groove 220. Compressible seal 100 is preferably dimensioned such that its width approximates the width of machined groove 220 while providing adequate clearance to allow the compressible seal 100 to be inserted within the groove 220. Alternatively, in those applications in which compressible seal 100 is to be installed in machined groove 220 under a vacuum, compressible seal 100 may have a width dimension that is greater than that of the machined groove 220.

Compressible seal 100 is likewise preferably formed of a material that may be colored in the molding or other manufacturing process, such that the final compressible seal 100 may be matched to the concrete surface in which it is to be installed.

FIGS. 3 through 9 show a method for repairing a crack in a concrete structure in accordance with certain aspects of an embodiment of the invention. As shown in the cross-sectional view of FIG. 4, crack 210 may extend from the interior of concrete wall 200 to its surface 205. Such a crack may be prone to movement over time, and may particularly allow water to leak through the crack toward surface 205. In order to repair such a crack and with reference to FIG. 5, at step 310, machined groove 220 having a constant width and depth is machined into the surface 205 of concrete wall 200 along the contour of crack 210. Groove 220 may be created by saw-cutting, using a specially designed router bit, or some combination of both. Of course, other methods of forming constant width and depth groove 220 may likewise be employed as will occur to those of ordinary skill in the art without departing from the spirit and scope of the invention.

After machined groove 220 is formed, at step 320 (and with reference to FIG. 6) a polymer adhesive 230 may be applied to the interior of machined groove 220, preferably along its entire length, or may be applied to the exterior walls of the body portion 104 of compressible seal 100 along preferably its entire length. Then, at step 330 (and with reference to FIG. 7), the compressible seal 100 is inserted into machined groove 220. Once again, as machined groove 220 will typically not comprise a straight line (as it follows the contour of the crack that is to be repaired), insertion of compressible seal 100 will typically involve bending compressible seal 100 along its length as it is inserted into machined groove 220 so as to match the contour of groove 220. As shown in FIG. 7, once compressible seal 100 is inserted into machined groove 220, adhesive 510 fills the spaces between adjacent ribs 112 on body portion 104 of compressible seal 100, thus permanently joining compressible seal 100 to the machined groove 220. Likewise, as the bottom side 106 of compressible seal 100 is contoured, once compressible seal 100 is placed within machined groove 220, a grout-receiving space 225 is defined between the bottom side 106 of compressible seal 100 and the bottom face of machined groove 220.

Figure 8:
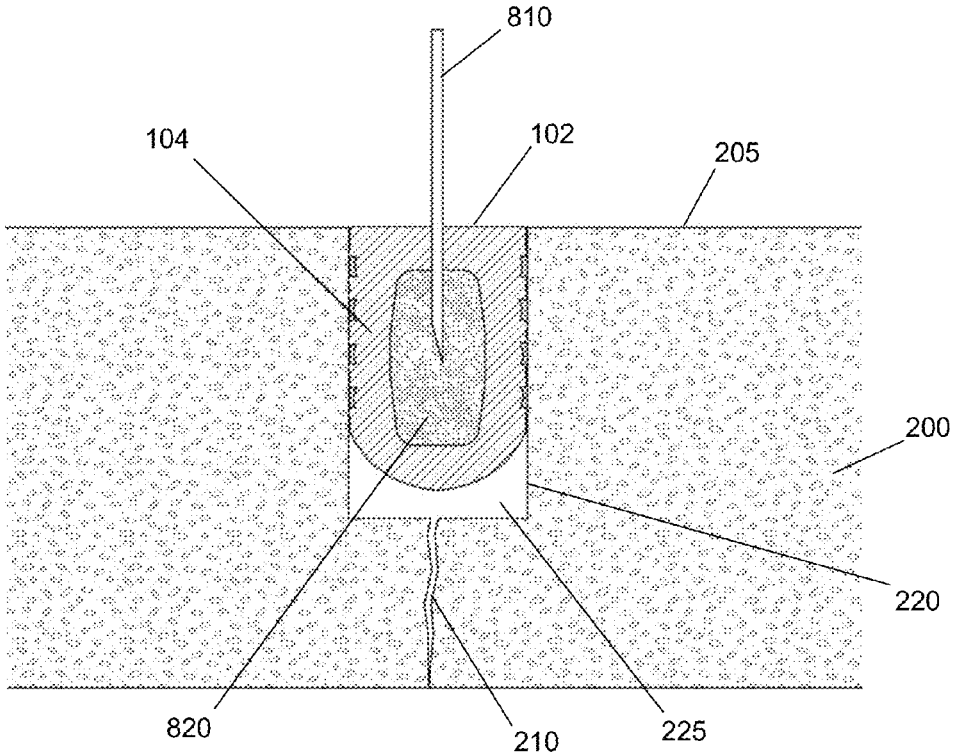
FIG. 8 is a side, cross-sectional view of the compressible seal of FIG. 7 in which the interior chamber is injected with an expansive material.

Next, at step 350, and with reference to FIG. 8, an injector 810 is passed through top side 102 of compressible seal 100 and into interior chamber 108, and a grout material 820 as described above may be injected into interior chamber 108 so as to inflate interior chamber 108. This, in turn, causes the sides of body portion 104 to be compressed between interior chamber 104 and the sidewalls of machined groove 220, thus creating a permanent pressurized seal above crack 210.

Alternatively, instead of injecting a grout material, air may be injected into interior chamber 108 so as to inflate the interior chamber 108 to create a permanent, pressurized seal above crack 210. Likewise, a vacuum may be applied to interior chamber 108 before it is placed within machined groove 220, causing the flexible sidewalls of body portion 104 of compressible seal 100 to be drawn inward. In this case, once the compressible seal 100 is positioned within machined groove 220, the vacuum may be removed from interior chamber 108, allowing compressible seal 100 to expand within machined groove 220 again to create a permanent, pressurized seal above crack 210. Those of ordinary skill in the art will recognize that such methods of inflating interior chamber 108 may be combined with one another as may be desirable for particular installations without departing from the spirit and scope of the invention.

Figure 9:
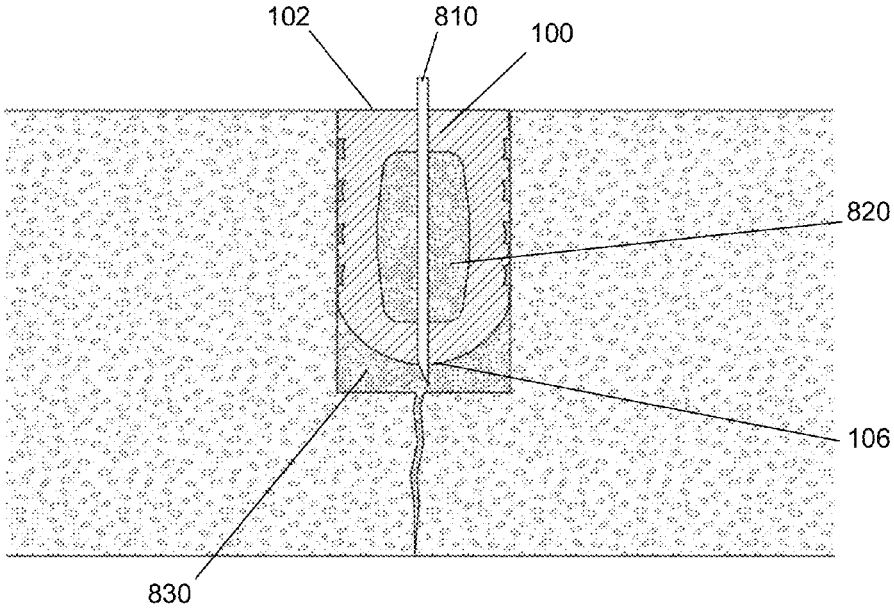
FIG. 9 is a side, cross-sectional view of the compressible seal of FIG. 8 in which a grout-receiving space is injected with a grout.

After interior chamber 108 has been so inflated, at step 360, and with reference to FIG. 9, injector 810 is extended into grout-receiving space 225 adjacent the bottom side 106 of compressible seal 100, and a grout is injected into grout-receiving space 225. Such grout thus fills the open space within second chamber 110, and likewise may flow at least partially into crack 210 to further seal the opening.

Thereafter, injector 810 may be removed, leaving installed in the machined groove 220 a pressurized seal that remains intact, preventing moisture intrusion even as the crack grows or the hydrostatic pressure in the crack increases.

Optionally, compressible seal 100 may be installed within machined groove 200 without inflation of interior chamber 108. In this case, after compressible seal 100 is affixed to the inside of machined groove 220 and the adhesive 230 holding compressible seal 100 has cured, injector 810 may be passed through compressible seal 100 and into grout-receiving space 225, and thereafter filled with grout (which again may at least partially flow into crack 210 to further seal the opening). As compressible seal 100 is affixed to the sidewalls of machined groove 220, it provides a permanent, pressure-tight seal above grout-receiving space 225, thus allowing the pressurized injection of grout into grout-receiving space 225 and crack 210, and thus providing a flexible and movable seal above the crack.

Those of ordinary skill in the art will also recognize that crack 210 may be injected with grout both prior to and throughout the process shown in FIGS. 3 through 9. For example, if crack 210 is actively leaking at the time that the above waterproofing method is to be performed, it would be desirable to inject caulk into the crack prior to creating machined groove 220. Likewise, should additional leakage from crack 210 be present after machined groove 220 is formed, additional caulk may be injected into crack 210 prior to installation of compressible seal 100 in machined groove 220.

Figure 10:
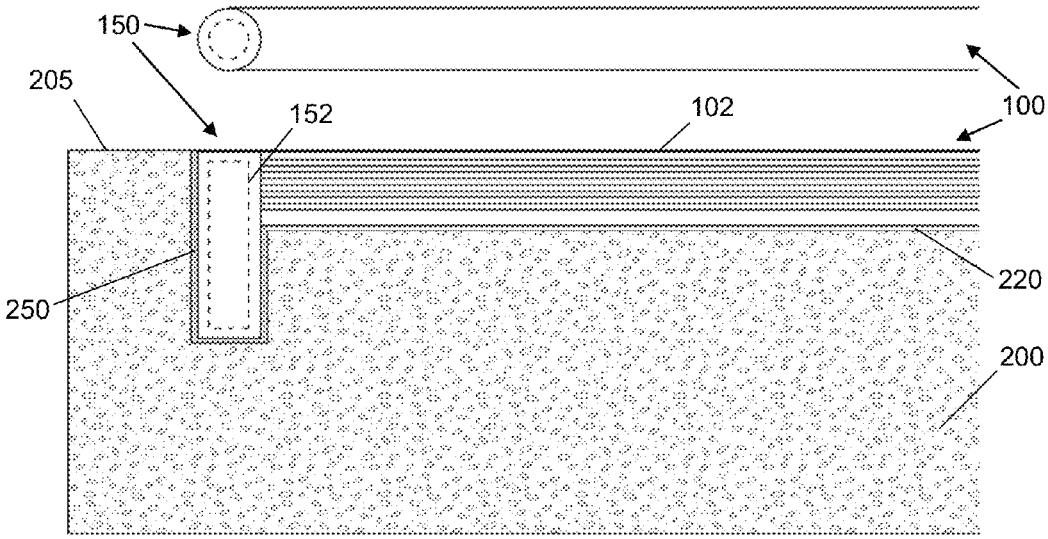
FIG. 10 is a side, cross-sectional view of the compressible seal of FIGS. 7 through 9 including an end plug.

Next, and with reference to FIG. 10, in order to have completely sealed, watertight conditions at the ends of compressible seal 100, cylindrical plugs 150 may be provided. Cylindrical plug 150 preferably has a hollow, interior chamber 152 that may be inflated in the same manner as interior chamber 108 so as to compress plug 150 against the opening into which it is inserted. Likewise, and as discussed above with regard to interior chamber 108 of compressible seal 100, cylindrical plugs 150 may alternatively be subjected to a vacuum during insertion into the opening, after which the vacuum may be withdrawn so as to allow cylindrical plug 150 to expand against that opening. As shown in FIG. 10, that opening may comprise a cylindrical bore 250 that extends into the face 205 of concrete wall section 200 to a depth that is deeper than machined groove 220. Cylindrical bore 250 may be coated with adhesive 230 so as to permanently affix cylindrical plug 150 once it is inserted within cylindrical bore 250, thus providing a permanently sealed, waterproof end plug for the compressible seal 100. Cylindrical plugs 150 may be of the same material as compressible seal 100 or of a compatible material, and may be heat welded or otherwise adhered to compressible seal 100. Cylindrical plugs 150 are preferably installed at the same time that the compressible seal 100 is installed.

Figure 11:
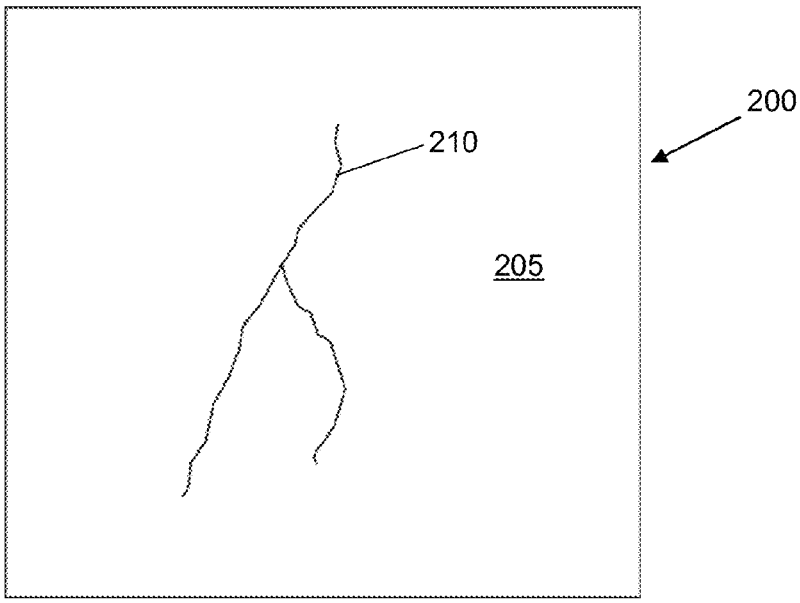
FIG. 11 is a top view of a crack having multiple sections suitable for repair using a method in accordance with the invention.
Figure 12:
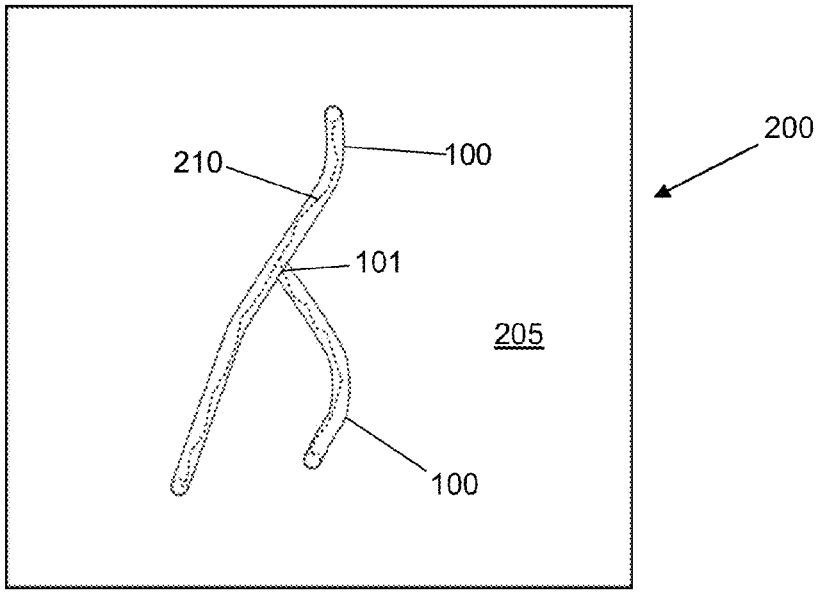
FIG. 12 is a top view of the crack of FIG. 11 with multiple sections of a compressible seal installed.

As shown in FIG. 11, it is possible that crack 210 may comprise multiple, intersecting sections. In this case, and as shown in FIG. 12, compressible seal 100 may likewise be provided in multiple, intersecting sections. In this case, the two distinct sections of compressible seal 100 may be joined to one another at intersection 101 using adhesive, by heat welding the two sections together, or in any other manner so as to permanently join the two sections to form a watertight connection.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

We claim:

1. A method of repairing a crack in a concrete structure, comprising the steps of:

identifying a path of a crack within a surface of a concrete structure;

forming a continuous, longitudinal groove having a constant depth and width in said surface and along said path;

affixing an elongate, longitudinal, compressible flexible insert on an interior of said groove and placing said flexible insert in a state of compression within said groove; and injecting a grout between a bottom face of said groove and a bottom face of said flexible insert while maintaining said flexible insert in said state of compression, and so that said grout is forced into said crack.

2. The method of claim 1, further comprising the step of:

inflating said flexible insert to form a permanent pressurized seal above said crack.

3. The method of claim 2, wherein said inflating step further comprises injecting air into a hollow chamber within an interior of said flexible insert.

4. The method of claim 2, wherein said inflating step further comprises:

applying a vacuum to a hollow chamber within an interior of said flexible insert; and releasing said vacuum after said flexible insert is positioned within said groove.

5. The method of claim 1, further comprising the step of:

injecting a grout into a hollow chamber within an interior of said flexible insert.

6. The method of claim 1, wherein said flexible insert has at least two sidewalls, and said flexible insert further comprises a plurality of ribs on said sidewalls and extending along a length of said flexible insert.

7. The method of claim 1, wherein said step of affixing said flexible insert further comprises adhering said flexible insert to said interior of said groove with an adhesive.

8. The method of claim 1, further comprising the step of:
bending said flexible insert along its length to conform to said path.

9. A method of repairing a crack in a concrete structure comprising the steps of:
providing a compressible, flexible seal comprising an elongate, longitudinal body portion having a top side and a bottom side opposite said top side, a hollow interior chamber within said body portion, and a plurality of ribs extending longitudinally along a length dimension of said body portion;
identifying a path of a crack within a surface of a concrete structure;
forming a continuous, longitudinal machined groove having a constant depth and width in said surface along said path, and wherein the bottom side of the compressible seal is configured to create a grout-receiving space between the bottom side of the compressible seal and the machined groove when said compressible seal is installed in said machined groove so that said top side is flush with said surface;
affixing said compressible seal on an interior of said machined groove and placing said compressible seal in a state of compression within said machined groove; and
injecting a grout into said grout-receiving space while maintaining said compressible seal in said state of compression so that said grout is forced into said crack.

10. The method of claim 9, further comprising the step of:
inflating said compressible seal to form a permanent pressurized seal above said crack.

11. The method of claim 10, wherein said inflating step further comprises injecting air into said hollow interior chamber.

12. The method of claim 10, wherein said inflating step further comprises:
applying a vacuum to said hollow interior chamber; and
releasing said vacuum after said flexible insert is positioned within said groove.

13. The method of claim 9, further comprising the step of:
injecting a grout into said hollow interior chamber.

14. The method of claim 9, wherein said step of affixing said compressible seal further comprises adhering said compressible seal to said interior of said groove with an adhesive.

15. The method of claim 9, further comprising the step of:
bending said compressible seal along its length to conform to said path.

16. A method of repairing a crack in a concrete structure comprising the steps of:
providing a compressible, flexible seal comprising an elongate, longitudinal body portion having a top side and a bottom side opposite said top side;
identifying a path of a crack within a surface of a concrete structure;
forming a machined groove having a constant depth and width in said surface along a continuous length of said path, and wherein the bottom side of the compressible seal is configured to create a grout-receiving space between the bottom side of the compressible seal and the machined groove when said compressible seal is installed in said machined groove so that said top side is flush with said surface;
affixing said compressible seal on an interior of said machined groove; and
injecting a grout into said grout-receiving space while maintaining said compressible seal in a state of compression within said machined groove to fill said grout-receiving space and at least a portion of said crack with said grout, and to form a permanently pressurized seal above said crack.

17. The method of claim 16, further comprising the step of:
inflating said compressible seal.

18. The method of claim 17, wherein said inflating step further comprises injecting air into a hollow chamber within an interior of said compressible seal.

19. The method of claim 17, wherein said inflating step further comprises:
applying a vacuum to a hollow chamber within an interior of said compressible seal; and
releasing said vacuum after said compressible seal is positioned within said groove.

20. The method of claim 16, further comprising the step of:
injecting a grout into a hollow chamber within an interior of said compressible seal.

21. The method of claim 16, wherein said compressible seal has at least two sidewalls, and said compressible seal further comprises a plurality of ribs on said sidewalls and extending along a length of said compressible seal.

22. The method of claim 16, where said step of affixing said flexible insert further comprises adhering said compressible seal insert to said interior of said groove with an adhesive.

23. The method of claim 16, further comprising the step of:
bending said compressible seal along its length to conform to said path.

24. A permanent seal in a machined groove within a concrete structure, wherein said machined groove extends along a path of a crack within said concrete structure and has a constant width and constant depth, the permanent seal comprising:
a compressible seal having a body portion having a top side and a bottom side opposite said top side, and two side walls between the top side and the bottom side, wherein the compressible seal is positioned within the machined groove so that the top side of said compressible seal is flush with a face of said concrete structure and a grout-receiving space is defined between said bottom side and a bottom face of said machined groove;
adhesive permanently affixing each of said side walls to each of two side faces of said machined groove; and
a grout filling said grout-receiving space and entering into at least a portion of said crack, wherein said grout is under compression and forms a permanent seal above said crack;
wherein said permanent seal has a terminating end adjacent ends of said machined groove, and a termination plug positioned at each terminating end, said termination plug comprising a compressible cylindrical plug positioned within a cylindrical bore extending into said face of said concrete structure to a depth that is greater than a depth of said machined groove, and an adhesive permanently affixing said compressible cylindrical plug to said cylindrical bore.

25. The permanent seal of claim 24, wherein said compressible seal further comprises a hollow interior chamber within said body portion configured for inflation so as to place said compressible seal in compression within said machined groove.

* * * * *